US006546741B2

(12) United States Patent
Yun et al.

(10) Patent No.: US 6,546,741 B2
(45) Date of Patent: Apr. 15, 2003

(54) POWER-SAVING APPARATUS AND METHOD FOR DISPLAY PORTION OF REFRIGERATOR

(75) Inventors: Keyong-Seok Yun, Changwon (KR); Byeong-Yeob Jin, Changwon (KR)

(73) Assignee: LG Electronics Inc., Seoul (KR)

( * ) Notice: Subject to any disclaimer, the term of this patent is extended or adjusted under 35 U.S.C. 154(b) by 30 days.

(21) Appl. No.: 09/881,838

(22) Filed: Jun. 18, 2001

(65) Prior Publication Data

US 2002/0038553 A1 Apr. 4, 2002

(30) Foreign Application Priority Data

Jun. 19, 2000 (KR) ..... 2000-033710
Dec. 30, 2000 (KR) ..... 2000-087366

(51) Int. Cl.[7] ..... F25B 49/02

(52) U.S. Cl. ..... 62/125; 62/131; 236/94; 345/102

(58) Field of Search ..... 62/125, 126, 127, 62/129, 130, 131; 239/94; 165/11.1, 237; 345/102

(56) References Cited

U.S. PATENT DOCUMENTS 4,615,179 A * 10/1986 Chiu et al. ..... 62/129
5,768,898 A * 6/1998 Seok et al. ..... 62/131 X
6,334,317 B1 * 1/2002 Bougauchi et al. ..... 62/127
6,426,736 B1 * 7/2002 Ishihara ..... 345/102
6,435,418 B1 * 8/2002 Toth et al. ..... 236/94

* cited by examiner

*Primary Examiner*—Harry B. Tanner
(74) *Attorney, Agent, or Firm*—Fleshner & Kim, LLP

(57) ABSTRACT

The present invention relates to a power-saving apparatus and method for a display portion of a refrigerator, and more particularly, to a power-saving apparatus and method for a display portion of a refrigerator in which brightness of the display portion is controlled only when a user utilizes the refrigerator. That is, the present invention aims to monitor whether the user utilizes the refrigerator and to control the brightness of the display portion of the refrigerator such that the display portion can be kept bright only when the user utilizes the refrigerator. To this end, the present invention is characterized in that whether the user utilizes the refrigerator or remains in the vicinity of the refrigerator is determined by using operating signals of function keys inputted by the user, a door switch, an infrared sensor and the like. Further, it is characterized in that the operation of a backlight portion is controlled in response to the result of the determination. Therefore, according to the present invention, there are advantages in that unnecessary consumption of electric power can be avoided in performing brightness control of a display portion of a product and use of the electric power of the product can be efficiently regulated.

8 Claims, 3 Drawing Sheets

POWER-SAVING APPARATUS AND METHOD FOR DISPLAY PORTION OF REFRIGERATOR

FIELD OF THE INVENTION

The present invention relates to a power-saving apparatus and method for a display portion of a refrigerator, and more particularly, to a power-saving apparatus and method for a display portion of a refrigerator in which brightness of the display portion is controlled only when a user utilizes the refrigerator.

BACKGROUND OF THE INVENTION

A refrigerator is a freezing apparatus for storing foodstuffs, cooking materials and the like as long as possible. Such a freezing apparatus controls inner temperature of the apparatus by a high-temperature and high-pressure refrigerant, which circulates a refrigerating cycle provided in the apparatus, in order to maintain and store the foodstuffs while preventing them from being spoiled. That is, the refrigerator generates cold air by the refrigerating cycle provided in the refrigerator, and is controlled so that the generated cold air is fed to the interior of the refrigerator based on its inner temperature. Thus, it is possible to keep the inner temperature of the refrigerator constant.

Accordingly, the basic function of the refrigerator is to keep the inner temperature of the refrigerator constant.

On the other hand, there is a growing tendency for the refrigerator to become larger, according to improvement of living standards and trends of consumers having preferences for multi-functional and large products. Accordingly, as the refrigerator becomes more larger, it has had an icemaker, a dispenser and the like in addition to a freezing chamber and a refrigerating chamber. Further, convenience of use and efficiency thereof have been pursued.

A displaying function of the refrigerator results from the tendency. That is, in order to improve the multi-functionalization and the efficiency of the refrigerator, a display portion informs a user of current operating state of the refrigerator and various kinds of messages to be informed by displaying them thereon.

FIG. 1 is a constitutional view schematically showing the brightness control of a display portion according to the prior art.

A conventional refrigerator includes a display portion 1 for displaying various kinds of information to be notified to a user; a backlight portion 7 for regulating the brightness of the display portion 1; a control portion 3 for controlling the drive of a refrigerating cycle for feeding cold air to the refrigerator, and the display on the display portion 1; and an input portion 5 for inputting operating signals of function keys by the user.

In the conventional refrigerator constructed as such, the backlight portion 7 is controlled such that it is always driven in a state where electric power is applied to the refrigerator.

FIG. 2 is a flowchart for control of the display portion of the conventional refrigerator.

The control portion 3 determines whether the refrigerator is in operation at step 100. At step 100, the determination that the refrigerator is in operation is made by confirming that the electric power is applied to the refrigerator. That is, in the state where the electric power is applied to the refrigerator, it is determined that the refrigerator is in operation.

If it is determined at step 100 that the refrigerator is in operation, the control portion 3 outputs driving signals to the backlight portion 7 (step 110). The backlight portion 7 is driven by the driving signals to regulate the display portion 1 brightly. Therefore, the backlight portion 7 is always kept in the driven state when the electric power is applied to the refrigerator.

In the driven state of the backlight portion 7, the control portion 3 monitors whether there are display signals according to input signals by the user through the input portion 5 or a driven state of the refrigerating cycle (step 120).

The control portion 3 outputs the display signals according to the condition of the step 120 to the display portion 1 that in turn, displays the display signals (step 130). In such a way, the display portion 1 displays the driven state of the refrigerating cycle and any informing signals to provide them to the user.

That is, in the conventional refrigerator, the backlight portion for regulating the brightness of the display portion is controlled in such a way that it always operates when the electric power is applied to the refrigerator. Thus, the display portion 1 is always kept bright by means of lighting-up operation of the backlight portion 7, so that various kinds of information is provided to the user.

The brightness control of the display portion of the conventional refrigerator that operates in this way has problems as follows.

The refrigerator is a product that operates all day long. Therefore, there was a problem in that the conventional brightness control of the display portion, which always keeps the display portion bright when the refrigerator is in operation, results in increased consumption of electric power.

Particularly, according to the conventional brightness control of the display portion, since the display portion is kept bright even in the daytime when it is not necessary for the display portion to be kept bright, the electric power was unnecessarily consumed.

Furthermore, even though the display portion of the refrigerator is constructed to have a function of displaying various kinds of information to be notified to the user, the display portion is kept bright even in a case where the user does not remain in the vicinity of the refrigerator. Thus, this has caused the unnecessary consumption of the electric power.

SUMMARY OF THE INVENTION

In view of the problems in the prior art, the present invention proposes an apparatus by which unnecessary consumption of electric power can be avoided in performing brightness control of a display portion of a product and use of the electric power of the product can be efficiently regulated.

That is, the present invention aims to control brightness of a display portion of a refrigerator such that the display portion can be kept bright when a user opens a door of the refrigerator, operating signals of function keys are inputted by the user, or behavior of the user is sensed by an infrared sensor.

Further, as for a product employing a touchscreen in which input and display are made in one apparatus, the present invention aims to control brightness of the touchscreen such that the touchscreen can be kept bright when screen contact signals are inputted by the user.

That is, the present invention aims to monitor whether the user utilizes the refrigerator and to control the brightness of the display portion of the refrigerator such that the display portion can be kept bright only when the user utilizes the refrigerator.

Therefore, an object of the present invention is to provide a power-saving apparatus and method for the display portion of the refrigerator, wherein the brightness of the display portion is controlled only when the user utilizes the refrigerator.

In order to achieve the above object, a power-saving apparatus for a display means of a refrigerator according to the present invention comprises the display means for displaying information to be notified to a user; a backlighting means for controlling brightness of the display means; a monitoring means for monitoring whether the user utilizes the refrigerator; and a control means for controlling operation of the backlighting means in response to a detected value from the monitoring means.

The monitoring means may be an infrared sensor installed on one side of a front surface of the refrigerator for monitoring whether the user remains in the vicinity of the refrigerator.

The monitoring means may be a door switch for monitoring the opening and closing of a door of the refrigerator.

The monitoring means may be an input means for inputting signals of keys according to selection by the user.

The control means may output signals to be displayed on the display means.

Furthermore, a power-saving method for a display portion of a refrigerator according to the present invention comprises the steps of determining whether a user utilizes the refrigerator; when the user utilizes the refrigerator, outputting signals for controlling brightness of the display portion; and outputting indication signals to the display portion.

The step of outputting the signals for controlling the brightness of the display portion may be performed only for a predetermined period of time.

Moreover, a power-saving method for a display portion of a refrigerator employing a touchscreen as the display portion on which information to be notified to a user is displayed or by which the user inputs signals, according to the present invention comprises the steps of monitoring touch action of the user on the touchscreen; when the touch action occurs, supplying the touchscreen with electric power for a predetermined period of time; and outputting indication signals to the touchscreen.

DETAILED DESCRIPTION FOR PREFERRED EMBODIMENT

Hereinafter, a power-saving apparatus for a display portion of a refrigerator according to the present invention will be explained in detail with reference to the accompanying drawings.

Figure 1:
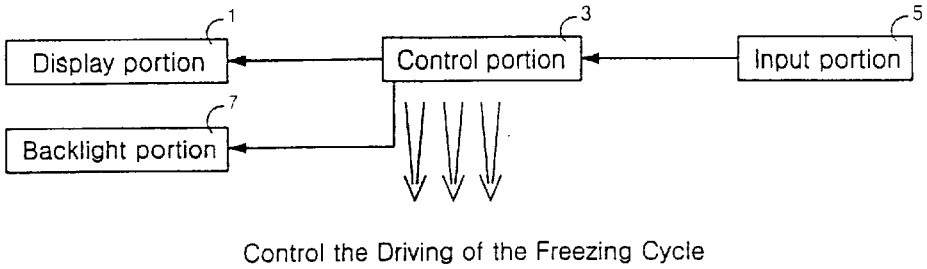
FIG. 1 is a constitutional view showing brightness control of a display portion according to the prior art.
Figure 2:
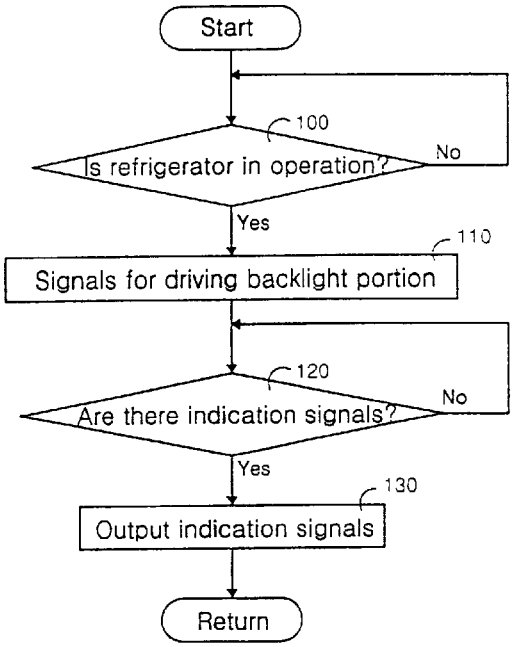
FIG. 2 is a flowchart of the brightness control of the display portion according to the prior art.
Figure 3:
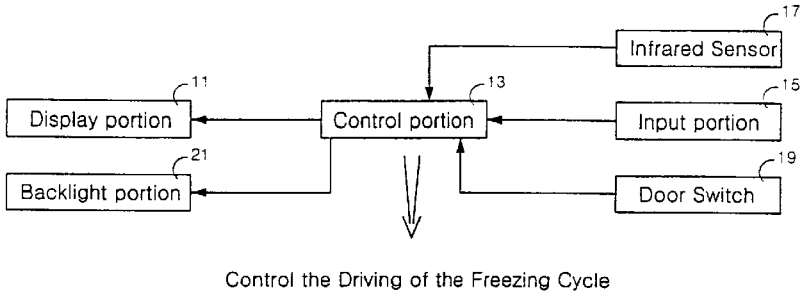
FIG. 3 is a constitutional view showing power-saving control of a display portion according to a first embodiment of the present invention.
Figure 4:
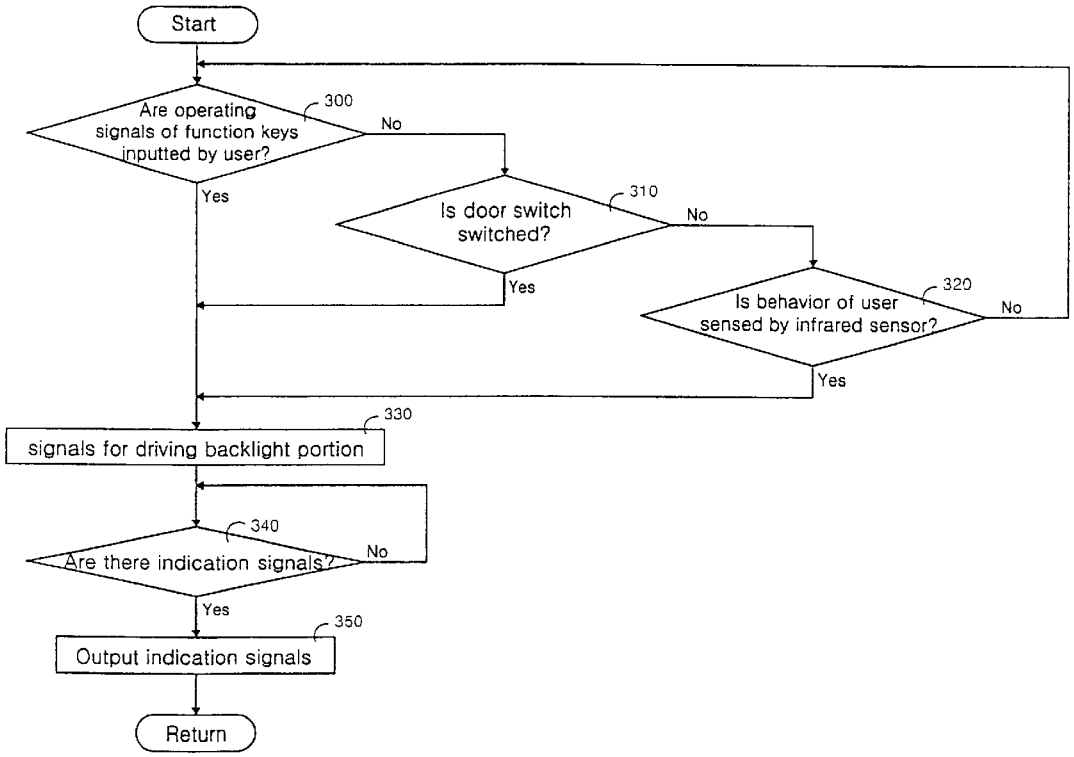
FIG. 4 is a flowchart of the power-saving control of the display portion according to the first embodiment of the present invention.

FIG. 3 is a constitutional view of the power-saving apparatus for the display portion of the refrigerator according to the present invention.

The power-saving apparatus for the display portion of the refrigerator includes an input portion 15 for inputting signals for setting functions such as temperature regulation of the refrigerator, a door switch 19 for sensing opening of the door of the refrigerator, and an infrared sensor 17 mounted on a front surface of the refrigerator for sensing behavior of the user within a predetermined cruising radius.

The input portion 15, the door switch 19 and the infrared sensor 17 are constitutional components for sensing whether the user utilizes the refrigerator. Therefore, in addition to the components, the power-saving apparatus may be further provided with additional components for sensing whether the user utilizes the refrigerator.

Moreover, the power-saving apparatus of the present invention includes a control portion 13 for determining whether the user utilizes the refrigerator, based on output signals from the components. That is, the control portion 13 receives the user's setting signals inputted from the input portion 15 for setting the functions and performs control according to the received user's setting signals while determining that the user utilizes the refrigerator. The control portion 13 also determines that the user has opened the door of the refrigerator, based on the sensed signals from the door switch 19. At this time, the control portion 13 performs necessary control (e.g., lighting-up of a lamp) according to the sensed signals and simultaneously determines that the user utilizes the refrigerator. Further, the control portion 13 determines that the user remains within the predetermined cruising radius in the vicinity of the refrigerator, based on the sensed signals from the infrared sensor 17.

Based on such determination information, the control portion 13 outputs signals for keeping the display portion bright so that information displayed on the display portion can be notified to the user.

That is, the power-saving apparatus of the present invention includes a backlight portion 21 for regulating the brightness of the display portion in accordance with the signals outputted from the control portion 13. The power-saving apparatus also includes the display portion 11 of which brightness can be regulated by the backlight portion 21.

The display portion 11 is constructed such that it displays the signals outputted from the control portion 13 to notify the user of the signals. Thus, the user can confirm the operating state of the refrigerator and the like by looking through the information displayed on the display portion 11.

The operating procedure of the power saving in the display portion of the refrigerator according to the present invention constructed as such will be described below.

Under the condition that the electric power is applied to the refrigerator, the control portion 13 controls drive of a refrigerating cycle for feeding cold air to the interior of the refrigerator. At this time, the backlight portion 21 for keeping the display portion 11 bright is not in operation. Thus, the display portion 11 remains dark.

In this way, under the operation of the refrigerator, the control portion 13 monitors whether the user utilizes the refrigerator. The monitoring operation is achieved by determining whether operating signals of function keys are inputted through the input portion 15 by the user at step 300.

If the operating signals of the function keys are inputted by the user at step 300, the control portion 13 performs functions corresponding to the inputted signals and simultaneously outputs signals for driving the backlight portion 21 (step 330).

That is, step 330 is performed to inform the user that the operating signals of the function keys inputted by the user at step 300 have been recognized. At this time, if a predetermined indication to be notified to the user should be given, the control portion 13 outputs indication signals to the display portion 11 (step 340).

At this time, since the display portion 11 is controlled through step 330 such that it is kept bright, the display portion displays the indication signals outputted from the control portion 13 on the bright display portion and thus allows the user to be notified (step 350).

Moreover, the operation of monitoring whether the user utilizes the refrigerator under the operation of the refrigerator is achieved by determining whether the door switch is switched through step 310.

That is, the determination in step 310 is made based on the operation of opening and closing the door of the refrigerator by the user. The determination of the switching operation of the door switch 19 by the control portion 13 is made by determining that the switching operation of the door switch 19 has been made in a case where a signal inputted from the door switch 19 to the control portion 13 is different from the previous signal.

The fact that the door switch 19 has been switched means that the user remains in the vicinity of the refrigerator. Therefore, even in this case, the control portion 13 outputs the signals for driving the backlight portion to the backlight portion 21 (step 330).

The display portion 11 is kept bright by the operation through step 330. Under this condition, the control portion 13 determines whether there are indication signals to be displayed on the display portion 11 (step 340). If there are any indication signals, the control portion outputs them to the display portion 11 (step 350).

The procedure has proceeded up to step 350, and thus, the indication signals outputted from the control portion 13 are displayed on the bright display portion 11. Therefore, the user can recognize the operating state of the refrigerator based on the information displayed thereon as such.

Next, in the operation of monitoring whether the user utilizes the refrigerator under the operation of the refrigerator, when the behavior of the user is sensed by the infrared sensor 17 through step 320, it is determined that the user utilizes the refrigerator.

The infrared sensor 17 is mounted on one side of a front surface of the refrigerator. Thus, when the user remains within the predetermined cruising radius in the vicinity of the refrigerator in the same manner that the user intends to confirm information displayed on the display portion 11 of the refrigerator, or the user puts or takes out foodstuffs in and from the refrigerator, the infrared sensor 17 outputs the sensed signals.

The signals outputted from the infrared sensor 17 are inputted to the control portion 13. The control portion 13 determines that the user remains in the vicinity of the refrigerator, based on the sensed signals from the infrared sensor 17.

At this time, the control portion 13 outputs the driving signals to the backlight portion 21 (step 330). The signals thus outputted cause the display portion 11 to be kept bright.

Further, if there are indication signals like steps 340 and 350, the indication signals are outputted to the display portion 11 in order to provide the user with information.

Moreover, it is preferable to control the signals for driving the backlight portion at step 330 such that they are outputted for a predetermined period of time. Alternatively, if there are no sensed signals from the infrared sensor 17, it is possible to shut off the signals for driving the backlight. That is, after the indication signals are displayed, the signals for driving the backlight are outputted for the predetermined period of time during which the user can confirm them and are then shut off.

According to the first embodiment of the present invention, when the user opens the door of the refrigerator or inputs the operating signals of the function keys, or when the behavior of the user is sensed by the infrared sensor, it is determined that the user utilizes the refrigerator or remains in the vicinity of the refrigerator. Therefore, in this case, the display portion of the refrigerator is controlled to be kept bright, so that various kinds of notifying information such as the current state and the setting state of the refrigerator displayed on the display portion can be provided to the user.

Figure 5:
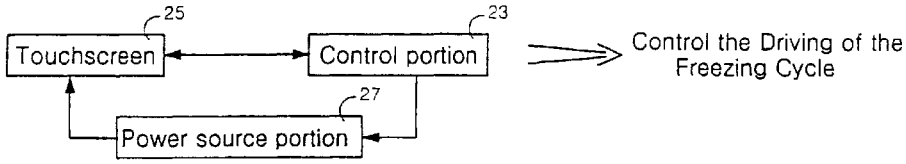
FIG. 5 is a constitutional view showing power-saving control of a display portion according to a second embodiment of the present invention.
Figure 6:
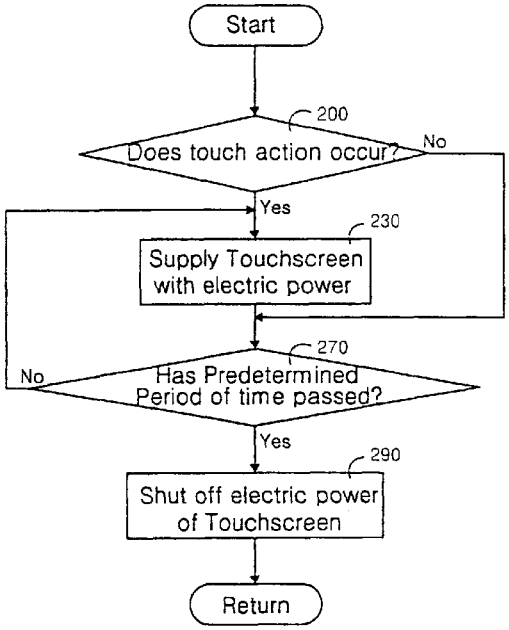
FIG. 6 is a flowchart of the power-saving control of the display portion according to the second embodiment of the present invention.

Next, FIGS. 5 and 6 are views showing the operation of power-saving control of a display portion according to a second embodiment of the present invention.

The second embodiment of the present invention is to control brightness of a touchscreen that constitutes the display portion of the refrigerator.

As shown in FIG. 5, the second embodiment of the present invention includes a touchscreen 25 that receives and transmits signals from and to a control portion 23. It also includes a power source portion 27 for controlling the electric power supplied to the touchscreen 25 in response to control of the control portion 23.

In a typical touchscreen, the constitution of inputting signals and the constitution of displaying the signals are integrated as a unit. Therefore, as for a product employing the touchscreen in which the input and the display are made in one apparatus, the present invention aims to control the brightness of the touchscreen such that the touchscreen can be kept bright when screen contact signals are inputted by the user.

That is, step 200 shown in FIG. 6 is a step of monitoring whether touch action is applied to the touchscreen 25.

Signals inputted from the touchscreen 25 through step 200 are inputted to the control portion 23. The control portion 23 receives sensed signals from the touchscreen and outputs control signals to the power source portion 27, so that the electric power can be supplied to the touchscreen 25 (step 230).

The touchscreen 25 is operated by the supplied electric power through step 230. Subsequently, indication signals from the control portion 23 are inputted to the touchscreen 25, and thus, information which the user wants to look through is displayed on the touchscreen.

On the other hand, after the touchscreen is operated through step 230, the control portion 23 monitors whether a predetermined period of time for displaying the information on the touchscreen has passed (step 270). The predetermined period of time to be set at step 270 is set by a period of time sufficient to entirely output the signals, which are transmitted from the control portion 23 to the touchscreen 25, and to fully confirm the displayed information by the user.

When the period of time set at step 270 has passed, the control portion 23 shuts off the control signals for the power source portion 27 so that the supply of the electric power to the touchscreen is shut off (step 290).

In this way, the second embodiment of the present invention is characterized in that the electric power is supplied to the touchscreen when it is determined that the user utilizes the refrigerator, which employs the touchscreen as the display portion, based on the touch action applied to the touchscreen by the user.

As described above, in a case where the display portion of the refrigerator is comprised of a display device such as an LCD and a backlight portion for controlling the brightness of the display device, the present invention is characterized in that whether the user utilizes the refrigerator or remains in the vicinity of the refrigerator is determined by using the operating signals of the function keys inputted by the user, the door switch, the infrared sensor and the like. Further, it is characterized in that the operation of the backlight portion is controlled in response to the result of the determination.

Moreover, in a case where the refrigerator employs the touchscreen as the display portion, the present invention is characterized in that the supply of the electric power to the touchscreen is controlled based on whether the user touches the touchscreen.

According to the power-saving apparatus for the display portion of the refrigerator of the present invention described above, the following advantages are obtained.

First, since the brightness of the display portion is controlled only when the user utilizes the refrigerator or remains in the vicinity of the refrigerator, the electric power for controlling the brightness of the display portion can be efficiently utilized.

Second, since the backlight portion and the touchscreen are supplied with the electric power and driven only when required, the life of them can be prolonged.

The basic technical spirit of the present invention is to control the brightness of the display portion of the refrigerator depending on whether the user utilizes the refrigerator. Of course, it is possible to make modifications and changes to the present invention without departing from the scope of the technical spirit.

For example, in a case where the present invention is applied to a cash dispenser, it is also possible to control a display panel of the cash dispenser such that it is operated only when the user utilizes the cash dispenser.

What is claimed is:

1. A power-saving apparatus for a display means of a refrigerator, comprising:

the display means for displaying information to be notified to a user;

a backlighting means for controlling brightness of the display means;

a monitoring means for monitoring whether the user utilizes the refrigerator; and a control means for controlling operation of the backlighting means in response to a detected value from the monitoring means.

2. The power-saving apparatus for the display means of the refrigerator as claimed in claim 1, wherein the monitoring means is an infrared sensor installed on one side of a front surface of the refrigerator for monitoring whether the user remains in the vicinity of the refrigerator.

3. The power-saving apparatus for the display means of the refrigerator as claimed in claim 1, wherein the monitoring means is a door switch for monitoring the opening and closing of a door of the refrigerator.

4. The power-saving apparatus for the display means of the refrigerator as claimed in claim 1, wherein the monitoring means is an input means for inputting signals of keys according to selection by the user.

5. The power-saving apparatus for the display means of the refrigerator as claimed in claim 1, wherein the control means outputs signals to be displayed on the display means.

6. A power-saving method for a display portion of a refrigerator, comprising the steps of:

determining whether a user utilizes the refrigerator;

when the user utilizes the refrigerator, outputting signals for controlling brightness of the display portion; and outputting indication signals to the display portion.

7. The power-saving method for the display portion of the refrigerator as claimed in claim 6, wherein the step of outputting the signals for controlling the brightness of the display portion is performed only for a predetermined period of time.

8. A power-saving method for a display portion of a refrigerator employing a touchscreen as the display portion on which information to be notified to a user is displayed or by which the user inputs signals, comprising the steps of:

monitoring touch action of the user on the touchscreen;

when said touch action occurs, supplying the touchscreen with electric power for a predetermined period of time; and outputting indication signals to the touchscreen.

* * * * *